US010505292B2

(12) United States Patent
Chadbourne

(10) Patent No.: US 10,505,292 B2
(45) Date of Patent: Dec. 10, 2019

(54) OXIDE INHIBITOR CAPSULE

(71) Applicant: Hubbell Incorporated, Shelton, CT (US)

(72) Inventor: Christopher Gilpin Chadbourne, Merrimack, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/602,406

(22) Filed: May 23, 2017

(65) Prior Publication Data

US 2017/0346198 A1 Nov. 30, 2017

Related U.S. Application Data

(60) Provisional application No. 62/340,632, filed on May 24, 2016.

(51) Int. Cl.

| | |
|---|---|
| ***H01R 4/10*** | (2006.01) |
| ***H01R 4/70*** | (2006.01) |
| ***H01R 4/18*** | (2006.01) |
| ***H01R 43/048*** | (2006.01) |
| ***H01R 4/20*** | (2006.01) |
| *H01R 4/62* | (2006.01) |

(52) U.S. Cl.
CPC ..... *H01R 4/70* (2013.01); *H01R 4/183* (2013.01); *H01R 4/20* (2013.01); *H01R 43/048* (2013.01); *H01R 4/62* (2013.01)

(58) Field of Classification Search
CPC ..... H01R 43/048; H01R 4/183; H01R 4/70
USPC ..... 439/519, 877, 880, 882, 203, 521; 174/87
See application file for complete search history.

(56) References Cited

U.S. PATENT DOCUMENTS

| | | | | |
|---|---|---|---|---|
| 2,423,290 A * | 7/1947 | Bonwitt | H01R 4/62 | 439/203 |
| 2,823,250 A * | 2/1958 | O'Keefe | H01R 4/22 | 174/87 |
| 2,869,103 A * | 1/1959 | Wells | H01R 4/62 | 439/203 |
| 2,901,722 A * | 8/1959 | Arnott, Jr. | H01B 1/22 | 439/203 |
| 3,326,442 A * | 6/1967 | Fattor | H01R 4/723 | 228/56.3 |
| 3,529,075 A * | 9/1970 | McDonald | H01R 4/08 | 174/87 |
| 3,612,748 A * | 10/1971 | James | H01R 4/08 | 174/94 R |

(Continued)

OTHER PUBLICATIONS

PCT/US2017/033949 International Search Report and Written Opinion dated Aug. 14, 2017 (15 pages).

*Primary Examiner* — Abdullah A Riyami
*Assistant Examiner* — Nelson R. Burgos-Guntin
(74) *Attorney, Agent, or Firm* — Michael Best & Friedrich, LLP

(57) ABSTRACT

An electrical connector assembly includes an electrical connector having a conductor receiving portion. The conductor receiving portion defines a cavity. The electrical connector assembly further includes a capsule positioned within the cavity of the conductor receiving portion. The capsule contains oxide inhibitor. The capsule is configured to release the oxide inhibitor into the cavity of the conductor receiving portion.

21 Claims, 2 Drawing Sheets

(56) References Cited

U.S. PATENT DOCUMENTS 3,708,611 A * 1/1973 Dinger ..... B29C 61/0616 174/84 C
3,879,575 A * 4/1975 Dobbin ..... G02B 6/4447 174/92
3,912,358 A * 10/1975 Miller ..... H01R 4/62 439/877
3,973,823 A * 8/1976 Stanback ..... H01R 4/62 439/877
4,214,121 A * 7/1980 Charneski ..... H01R 3/08 174/84 C
5,023,402 A * 6/1991 King, Jr. ..... H01R 4/22 174/87
5,118,313 A * 6/1992 Delalle ..... H01R 4/72 439/730
5,422,438 A * 6/1995 Lamome ..... H01R 4/203 174/76
6,951,491 B2 * 10/2005 Sakaguchi ..... H01R 4/20 439/760
7,174,633 B2 * 2/2007 Onuma ..... H01R 4/04 29/854
7,473,125 B2 * 1/2009 Murakami ..... H01R 12/592 439/260
7,537,475 B2 * 5/2009 Wise ..... H01R 13/62 439/276
7,887,351 B2 * 2/2011 Wang ..... H01R 12/88 439/260
8,084,691 B2 * 12/2011 Pullium, III ..... H01R 4/70 174/92
9,108,178 B2 * 8/2015 Calle ..... B01J 13/14
9,774,132 B2 * 9/2017 Lindkamp ..... H01R 13/5205
D800,070 S * 10/2017 Manba ..... D13/147
9,859,639 B2 * 1/2018 Tagami ..... H01R 12/88
2005/0164547 A1 * 7/2005 Sakaguchi ..... H01R 4/70 439/521
2006/0180336 A1 * 8/2006 King, Jr. ..... H01R 4/22 174/87
2007/0240301 A1 * 10/2007 Johnson ..... H01R 4/5083 29/748
2008/0305362 A1 12/2008 Schroeder et al.
2009/0269968 A1 * 10/2009 Nemoto ..... H01R 12/88 439/377
2009/0318001 A1 * 12/2009 Hemmi ..... H01R 12/771 439/260
2010/0227491 A1 * 9/2010 Tsai ..... H01R 23/661 439/260
2011/0151682 A1 * 6/2011 Kodaira ..... H01R 12/594 439/55
2011/0275238 A1 * 11/2011 Iijima ..... H01R 12/88 439/492
2011/0275725 A1 * 11/2011 Meyering ..... A61L 27/34 514/786
2012/0207921 A1 8/2012 Calle et al.
2012/0249659 A1 10/2012 Walsh et al.
2014/0273614 A1 9/2014 Kuczynski et al.
2016/0141785 A1 * 5/2016 Yokoo ..... H01R 12/88 439/733.1
2017/0062963 A1 * 3/2017 Tagami ..... H01R 12/88
2017/0331206 A1 * 11/2017 Manba ..... H01R 12/79
2017/0346198 A1 * 11/2017 Chadbourne ..... H01R 4/183

* cited by examiner

OXIDE INHIBITOR CAPSULE

CROSS-REFERENCE TO RELATED APPLICATION

This application claims priority to co-pending U.S. Provisional Patent Application No. 62/340,632, filed May 24, 2016, the entire contents of which are incorporated herein by reference.

FIELD

The application relates to oxide inhibitor compound, and in particular, delivery methods for oxide inhibitor compound to electrical connectors.

SUMMARY

Oxide inhibitor is a corrosion inhibiting chemical compound that is added to a liquid or a gas to decrease corrosion of a material, such as a metal or alloy, due to oxygen. This is typically done by forming a coating, or passivation layer, on the material that prevents access of the corrosive substance (e.g., air or water) to the coated material, thereby preventing oxidation. Oxide inhibitor is often used in conjunction with electrical connectors to prevent oxidation at an electrical connection by sealing out air and moisture. Electrical resistance through the electrical connection is kept low and service life of the electrical connector is improved by preventing oxidation. In such cases, in which the oxide inhibitor is used with electrical connectors, the oxide inhibitor is typically conductive to promote electrical communication through the electrical connection.

The oxide inhibitor is either pre-applied to the electrical connector, or is applied in the field using a bottle or caulking gun tube. Often an excessive amount of inhibitor is applied to the electrical connector to ensure a thorough coating. This results in excess oxide inhibitor being wasted by being spilled out of the electrical connector when a conductor is inserted, or when one or more crimps are made in the electrical connector. This can be messy, wasteful, and may be a potential disposal concern. Although oxide inhibitor may be pre-applied relatively consistently to an electrical connector during a manufacturing process, there still may be undesirable variation in the quantity of oxide inhibitor applied. This variation is even greater when the oxide inhibitor is applied in the field, resulting in too little or too much of the oxide inhibitor being applied to the electrical connector during installation.

In one embodiment, the application provides an electrical connector assembly. The electrical connector assembly includes an electrical connector having a conductor receiving portion, The conductor receiving portion defines a cavity. The electrical connector assembly further includes a capsule positioned within the cavity of the conductor receiving portion. The capsule contains oxide inhibitor. The capsule is configured to release the oxide inhibitor into the cavity of the conductor receiving portion.

In another embodiment, the application provides an oxide inhibitor capsule. The oxide inhibitor capsule includes an outer capsule wall, and a cavity defined by the outer capsule wall. The oxide inhibitor capsule further includes an oxide inhibitor contained within the cavity. The outer capsule wall is configured to release the oxide inhibitor, the oxide inhibitor being configured to inhibit oxidation of a metal or alloy.

In yet another embodiment the application provides a method of delivering corrosion inhibitor to an electrical connector. The method includes positioning an oxide inhibitor capsule containing oxide inhibitor within a conductor receiving portion of the electrical connector. The method further includes inserting a conductor into the conductor receiving portion of the electrical connector. The method further includes rupturing the oxide inhibitor capsule, in which rupturing the oxide inhibitor capsule releases the oxide inhibitor between the conductor and the electrical connector. .

Other aspects of the application will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
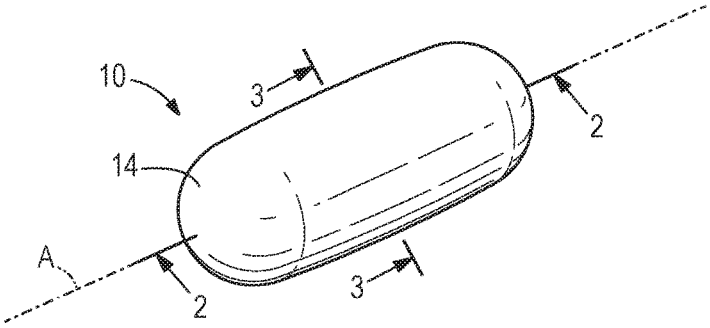
FIG. 1 is a perspective view of an oxide inhibitor capsule according to some embodiments.

FIG. 1 illustrates a corrosion or oxide inhibitor capsule 10 having a capsule shell or outer capsule wall 14 forming an elongated pill shape having a longitudinal axis A according to some embodiments. The outer capsule wall 14 defines an interior cavity 18 containing a predetermined amount of oxidation inhibitor or oxide inhibitor 50 (FIGS. 2-3).

Figure 2:
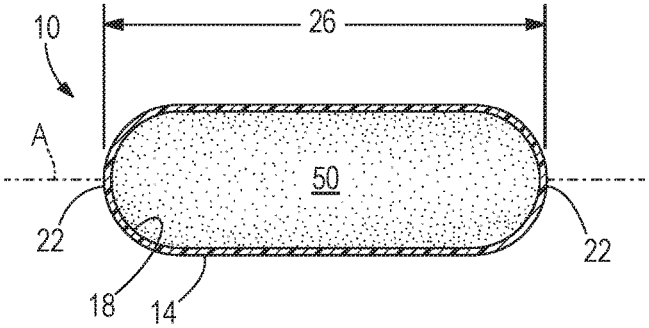
FIG. 2 is a cross-sectional view of the oxide inhibitor capsule of FIG. 1 through line 2-2 in FIG. 1 according to some embodiments.

With reference to FIG. 2, the oxide inhibitor capsule 10 has opposing ends 22 that the longitudinal axis A extends between. A length 26 of the capsule 10 is defined between the opposing ends 22 along the longitudinal axis A. In the illustrated embodiment, each of the ends 22 forms a hemisphere.

Figure 3:
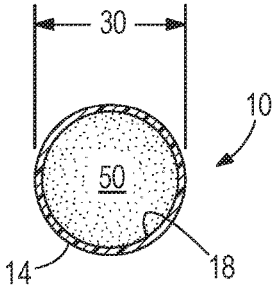
FIG. 3 is a cross-sectional view of the oxide inhibitor capsule of FIG. 1 through line 3-3 in FIG. I according to some embodiments.

With reference to FIG. 3, the capsule 10 has a circular cross-section transverse to the longitudinal axis A of the capsule 10. The capsule 10 has an outer dimension 30 transverse to the longitudinal axis A. In some embodiments, the outer dimension 30 is an outer diameter of the capsule 10. The outer dimension 30 may be uniform along at least a portion of the length of the capsule 10 or only at a one point along the length of the capsule 10.

The outer capsule wall 14 is formed from a Thin membrane that may be deliberately punctured or ruptured to release the oxide inhibitor 50. In the illustrated embodiment, the outer capsule wall 14 is a single-piece integral enclosure. In some embodiments, the outer capsule wall 14 is formed from two halves that are fitted together. In such embodiments, one half is a lower-diameter body and the other half is a higher-diameter cap that fits over the lower diameter body to form the interior cavity 18. In other embodiments, the outer capsule wall 14 is formed from any number of portions that are coupled together to define the interior cavity 18. In some embodiments, the outer capsule wall 14 is made from a highly conductive material. In some embodiments, the outer capsule wall 14 is made to dissolve or disintegrate after being ruptured. In some embodiments, the outer capsule wall 14 may include oxide inhibitor compound itself, so once ruptured, inhibits or prevents oxidation in conjunction with the enclosed oxide inhibitor 50. In some embodiments, the outer capsule wall 14 is made from gelatin or another suitable material.

In the illustrated embodiment, the oxide inhibitor 50 is a liquid that includes a compound for inhibiting or preventing oxidation. In some embodiments, the compound is for inhibiting or preventing oxidation in a specific material (e.g., aluminum or copper) or pair of materials (e.g., aluminum to aluminum connections, or copper to aluminum connections). In some embodiments, the oxide inhibitor 50 is a liquid, such as oil or grease, having a low viscosity conducive to flowing into small crevices and across broad surfaces to provide a thorough coat. In some embodiments, the oxide inhibitor 50 includes one or more elements so as to act as a lubricant or anti-seizing compound. Although described in terms of oxidation, in other embodiments, the oxide inhibitor compound of the oxide inhibitor 50 may be substituted with another type of corrosion inhibiting compound. In such embodiments, the corrosion inhibiting compound may inhibit or prevent corrosion caused by at least one particular chemical reacting with at least one particular material.

Figure 4:
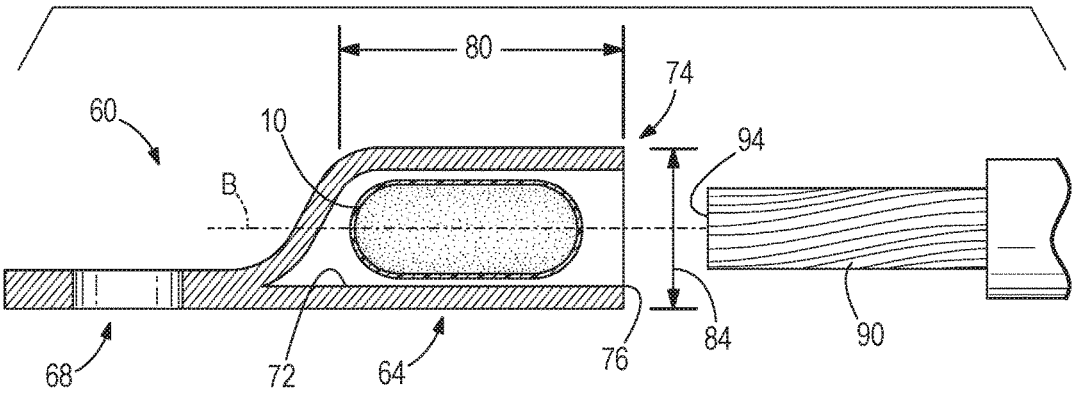
FIG. 4 is a cross-sectional view of an electrical connector and a conductor, illustrating an oxide inhibitor capsule received within a barrel portion of the electrical connector, and a conductor according to some embodiments.

FIG. 4 illustrates an electrical connector 60 having a conductor receiving portion or barrel portion 64 and a flat portion 68. The barrel portion 64 defines a conductor receiving cavity or barrel cavity 72 extending along a longitudinal axis 13 of the barrel portion 64 for receiving a conductor 90 (e.g., a wire). The barrel portion 64 further defines an opening 74 at a distal end 76 of the barrel portion 64 extending into the barrel cavity 72. The barrel cavity 72. has a length 80 along the longitudinal axis B of the barrel portion 64 of the electrical connector 60. The barrel cavity 72 has an inner dimension 84 transverse to the longitudinal axis B. In some embodiments, the barrel portion 64 is substantially cylindrical such that the barrel cavity 72 has a circular cross-section and the inner dimension 84 is an inner diameter of the barrel cavity 72. In other embodiments, each of the barrel portion 64 and the barrel cavity 72 may have another cross-sectional shape, such as a rectangular cross-section. Although illustrated and. described as a barrel shaped compression connector, the electrical connector 60 shown is merely exemplary. In other embodiments, the electrical connector 60 may be any suitable type of electrical connector with various different shapes and dimensions. Although the conductor 90 is illustrated as a wire, in other embodiments, the conductor 90 may be a second electrical connector configured to electrically connect with the first electrical connector 60.

With continued reference to FIG. 4, when connecting the conductor 90 with the electrical connector 60, it is desirable to apply oxide inhibitor between the conductor 90 and the electrical connector 60. Accordingly, an oxide inhibitor capsule 10 is selected from a plurality of oxide inhibitor capsules. The plurality of oxide inhibitor capsules may each have various different dimensions and qualities. The oxide inhibitor capsule 10 may be selected according to a dimension of the capsule 10, such as the length 80 and the outer dimension 30, and/or a dimension of the electrical connector 60, such as the length 80 and the inner dimension 84 of the barrel cavity 72 of the barrel portion 64. For example, the oxide inhibitor capsule 10 may be selected so the length 26 is approximately equal to or less than the length 80 of the barrel portion 64, and/or so the outer dimension 30 of the oxide inhibitor capsule 10 is approximately equal to or less than the inner dimension 84 of the barrel cavity 72. The oxide inhibitor capsule 10, and in particular, the oxide inhibitor compound of the capsule 10, may be selected based on the material of one or both of the electrical connector 60 and the conductor 90. The oxide inhibitor capsule 10 may also be selected based on a desired quantity of oxide inhibitor 50 contained within the interior cavity 18 of the capsule 10. The desired quantity of oxide inhibitor 50 contained within the capsule 10 may be driven by a predetermined quantity of oxide inhibitor 50 required for a specific electrical connector.

Once the oxide inhibitor capsule 10 is selected, the oxide inhibitor capsule 10 is axially inserted through the opening 74 into the barrel cavity 72 of the barrel portion 64 along the longitudinal axis B to position the oxide inhibitor capsule 10 within the barrel cavity 72, as shown in FIG. 4. If the outer dimension 30 of the capsule 10 is approximately equal to or slightly greater than the inner dimension 84 of the barrel cavity 72, the capsule 10 may be retained within the barrel cavity 72 via a pressure fit. Alternatively, the capsule 10 may be retained within the barrel cavity 72 by another suitable method (e.g., adhesive).

Figure 5:
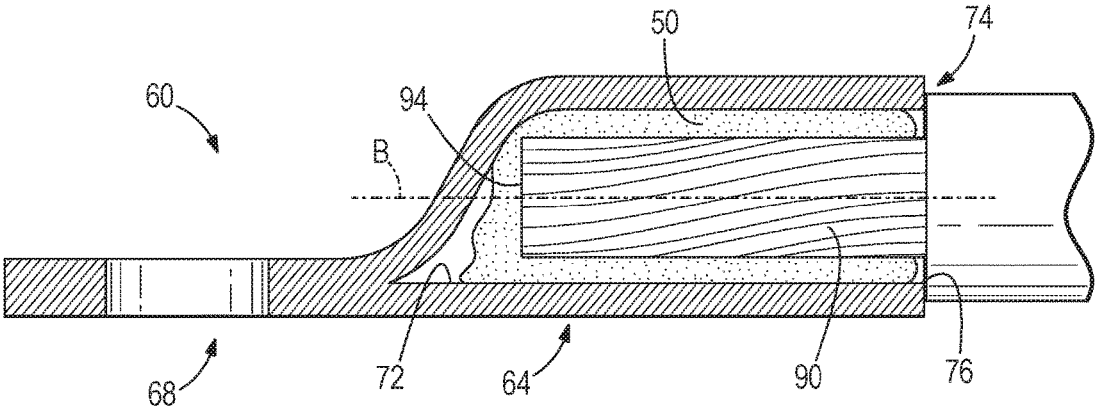
FIG. 5 is a cross-sectional view of the electrical connector and the conductor of FIG. 4, illustrating the conductor received in the barrel portion of the electrical connector and the oxide inhibitor capsule ruptured inside the barrel portion according to some embodiments.

After inserting the inhibitor capsule 10 into the barrel cavity 72, an end 94 of the conductor 90 may be axially inserted into the barrel cavity 72 through the opening 76, as shown in FIG. 5. As the conductor 90 is inserted into the barrel cavity 72 the outer capsule wall 14 of the capsule 10 is ruptured by being punctured or compressed by the conductor 90 within the barrel cavity 72. The oxide inhibitor 50 is released so as to coat the barrel cavity 72 and the conductor 90, thereby providing a layer or coating between the electrical connector 60 and the conductor 90. This layer promotes electrical communication between the electrical connector 60 and the conductor 90 by inhibiting and reducing oxidation of the electrical connector 60 and the conductor 90 where they make contact. This is because oxidation can act as an insulator, thereby increasing electrical resistance between the electrical connector 60 and the conductor 90, and by reducing oxidation an increase in the electrical resistance is also reduced. In some embodiments, the oxide inhibitor 50 may also be conductive so as to further promote electrical conductivity between the electrical connector 60 and the conductor 90.

Figure 6:
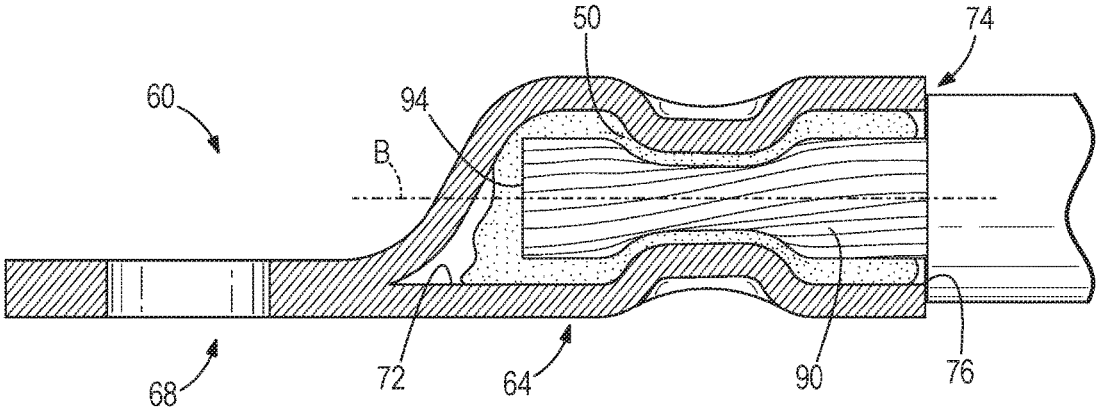
FIG. 6 is a cross-sectional view of the electrical connector and the conductor of FIG. 4, illustrating the barrel portion of the electrical connector crimped to connect the electrical connector with the conductor according to some embodiments.

The barrel portion 64 may then be crimped one or more times to securely connect the electrical connector 60 and the conductor 90, as best shown in FIG. 6. In some embodiments, the capsule 10 and/or the barrel cavity are sized and dimensioned such that the capsule 10 only ruptures once crimping is performed on the barrel portion 64 of the electrical connector 60 to connect the electrical connector 60 and the conductor 90. In some embodiments, the electrical connector 60 and the conductor 90 are secured together by another suitable connection type.

The capsule 10 may be inserted into the barrel cavity 72 of the barrel portion 64 during manufacture of the electrical connector 60. Accordingly, when the capsule 10 is inserted into the barrel cavity 72 during manufacture of the electrical connector 60, the user does not need to insert the capsule 10 within the barrel cavity 72 in the field. In either case by providing a predetermined amount of the oxide inhibitor 50 within the capsule 10, a specific amount required for the electrical connector 60 may be provided with reduced variation and no manual error.

During manufacture of the capsule 10, the interior cavity 18 of the capsule 10 is filled with a specific predetermined quantity of oxide inhibitor 50. The interior cavity 18 may be entirely filled with oxide inhibitor 50. Alternatively, the interior cavity 18 may only be partially filled with oxide inhibitor 50. The interior cavity 18 may be entirely or partially filled with a specific predetermined quantity, such as a predetermined quantity required for a specific electrical connector.

Additionally the capsules may be organized and packaged according to different characteristics, such as size (e.g., length or diameter), type of inhibitor compound, and/or quantity of inhibitor compound. Alternatively, the capsules may be organized and packaged according to an electrical connector for which the capsules correspond, which may vary the above characteristics accordingly.

Although in the illustrated embodiment the capsule 10 has an elongated pill shape, the capsule 10 may be any shape suitable for a particular electrical connector. For example, the capsule 10 may be a sphere or an elongated spheroid.

In general, the oxide inhibitor capsule includes an outer capsule wall defining a cavity containing oxide inhibitor. The outer capsule wall is dimensioned so as to be received within a barrel portion of an electrical connector.

Although aspects have been described in detail with reference to certain preferred embodiments, variations and modifications exist within the scope and spirit of one or more independent aspects as described. Various features and advantages are set forth in the following claims.

What is claimed is:

1. An electrical connector assembly comprising:

an electrical connector including a conductor receiving portion, the conductor receiving portion defining a cavity; and a capsule positioned within the cavity of the conductor receiving portion, the capsule containing oxide inhibitor, the capsule being configured to release the oxide inhibitor into the cavity of the conductor receiving portion, and an outer capsule wall, wherein the outer capsule wall is formed of at least one selected from a group consisting of a gelatin, an oxide inhibitor, and a conductive material.

2. The electrical connector and capsule assembly of claim 1, wherein the conductor receiving portion defines an opening extending into the cavity, and wherein the capsule is dimensioned to be received within the cavity through the opening.

3. The electrical connector and capsule assembly of claim 1, wherein the cavity has an inner dimension transverse to a longitudinal axis of the cavity and the capsule has an outer dimension transverse to a longitudinal axis of the capsule, and wherein the outer dimension of the capsule is approximately equal to or less than the inner dimension of the cavity.

4. The electrical connector and capsule assembly of claim 1, wherein the cavity has a length extending along a longitudinal axis of the cavity and the capsule has a length extending along a longitudinal axis of the capsule, and wherein the length of the capsule is equal to or less than the length of the cavity.

5. The electrical connector and capsule assembly of claim 1, wherein the capsule is rupturable to release the oxide inhibitor.

6. The electrical connector and capsule assembly of claim 1, wherein the electrical connector is at least one selected from the group consisting of a metal and an alloy, and wherein the oxide inhibitor inhibits oxidation of the at least one selected from the group consisting of the metal and the alloy.

7. The electrical connector and capsule assembly of claim 6, wherein the at least one selected from the group consisting of the metal and the alloy is one of aluminum or copper.

8. The electrical connector and capsule assembly of claim 1, wherein the electrical connector is configured to form an electrical connection with a conductor, and wherein the cavity of the conductor receiving portion is configured to receive the conductor.

9. The electrical connector and capsule assembly of claim 1, wherein the capsule contains a predetermined quantity of the oxide inhibitor required specifically for the electrical connector.

10. An oxide inhibitor capsule, comprising:

an outer capsule wall, wherein the outer capsule wall is formed of at least one selected from a group consisting of a gelatin, an oxide inhibitor, and a conductive material;

a cavity defined by the outer capsule wall; and an oxide inhibitor contained within the cavity, the outer capsule wall being configured to release the oxide inhibitor, the oxide inhibitor being configured to inhibit oxidation of at least one selected from the group consisting of a metal and an alloy.

11. The oxide inhibitor capsule of claim 10, wherein the outer capsule wall is made of a rupturable material so as to release the oxide inhibitor when ruptured.

12. The oxide inhibitor capsule of claim 10, wherein the outer capsule wall has an elongated pill shape.

13. The oxide inhibitor capsule of claim 10, wherein the cavity contains a predetermined quantity of the oxide inhibitor required for a specific electrical connector.

14. A method of delivering oxide inhibitor to an electrical connector, the method comprising:

positioning an oxide inhibitor capsule containing oxide inhibitor within a conductor receiving portion of the electrical connector, wherein the capsule includes an outer capsule wall, and wherein the outer capsule wall is formed of at least one selected from a group consisting of a gelatin, an oxide inhibitor, and a conductive material;

inserting a conductor into the conductor receiving portion of the electrical connector; and rupturing the oxide inhibitor capsule, wherein rupturing the oxide inhibitor capsule releases the oxide inhibitor between the conductor and the electrical connector.

15. The method of claim 14, further comprising selecting the oxide inhibitor capsule from a plurality of oxide inhibitor capsules.

16. The method of claim 15, wherein selecting the oxide inhibitor capsule from the plurality of oxide inhibitor capsules includes selecting oxide inhibitor capsule based on a dimension of the oxide inhibitor capsule.

17. The method of claim 16, wherein the dimension is a length of the oxide inhibitor capsule extending along a longitudinal axis of the oxide inhibitor capsule, and wherein the length of the oxide inhibitor capsule is approximately equal to or less than a length of the conductor receiving portion.

18. The method of claim 16 wherein the dimension is an outer dimension of the oxide inhibitor capsule transverse to a longitudinal axis of the oxide inhibitor capsule, and wherein the outer dimension is approximately equal to or less than an inner dimension of a cavity of the conductor receiving portion.

19. The method of claim 15, wherein the oxide inhibitor capsule is selected based on a material of at least one of the electrical connector and the conductor.

20. The method of claim 14, further comprising crimping the conductor receiving portion of the electrical connector.

21. The method of claim 20, wherein the step of rupturing the oxide inhibitor capsule occurs during at least one selected from the group consisting of:

inserting the conductor into the conductor receiving portion of the electrical connector, and crimping the conductor receiving portion of the electrical connector.

* * * * *